US005642711A

United States Patent [19]

Boner et al.

[11] Patent Number: 5,642,711

[45] Date of Patent: Jul. 1, 1997

[54] APPARATUS FOR AUTOMATICALLY CONTROLLING OPERATION OF THE THROTTLE ASSEMBLY OF A MOTOR VEHICLE ENGINE SYSTEM DURING OPERATION OF POWER TAKE-OFF EQUIPMENT

[75] Inventors: William Boner, Trenton, N.J.; Warren Kimble, Levittown, Pa.

[73] Assignee: Automated Waste Equipment Co., Inc., Trenton, N.J.

[21] Appl. No.: 601,905

[22] Filed: Feb. 15, 1996

[51] Int. Cl.[6] ..... F02D 7/00

[52] U.S. Cl. ..... 123/379; 123/376

[58] Field of Search ..... 123/379, 376, 123/398, 401, 338, 377, 385, 388; 180/176, 306, 197

[56] References Cited

U.S. PATENT DOCUMENTS

| | | | |
|---|---|---|---|
| Re. 25,012 | 7/1961 | Dressler . | |
| 436,355 | 6/1890 | Bonnier | 123/401 |
| 2,224,600 | 12/1940 | Howard . | |
| 2,852,086 | 9/1958 | Cordry . | |
| 2,916,100 | 12/1959 | Teetor . | |
| 3,102,522 | 9/1963 | Nallinger . | |
| 3,913,697 | 10/1975 | Greene . | |
| 3,916,854 | 11/1975 | Barton et al. . | |
| 3,954,152 | 5/1976 | Duttarer et al. . | |
| 4,082,074 | 4/1978 | Baugh | 123/379 |
| 4,205,645 | 6/1980 | Eheim | 123/379 |
| 4,252,090 | 2/1981 | Baugh | 123/379 |
| 4,262,642 | 4/1981 | Suerdlin | 123/385 |
| 4,445,476 | 5/1984 | Eheim . | |
| 4,450,804 | 5/1984 | Sauerschell et al. . | |
| 4,457,392 | 7/1984 | Caldwell | 123/379 |
| 4,574,757 | 3/1986 | Schulman | 123/401 |
| 4,640,245 | 2/1987 | Matsuda | 123/401 |
| 4,741,309 | 5/1988 | Bergen | 123/376 |
| 4,774,921 | 10/1988 | Sakaguchi | 123/385 |
| 5,056,615 | 10/1991 | Duthie et al. . | |
| 5,152,360 | 10/1992 | Haefner et al. . | |
| 5,235,948 | 8/1993 | Grant et al. . | |
| 5,311,961 | 5/1994 | Stabenow . | |

*Primary Examiner*—Carl S. Miller
*Attorney, Agent, or Firm*—Sperry, Zoda & Kane

[57] ABSTRACT

A controlling system is provided for use with a motor vehicle which includes auxiliary equipment usually being pneumatically powered and designed to be operated by a power take-off switch wherein throttle control by the accelerator pedal of the motor vehicle is blocked during operation of the power take-off equipment and wherein control of vehicle motor operating speed is controllable through a throttle control system accessible within the vehicle driving compartment or externally. The apparatus is preferably all pneumatically controlled and is connected to receive pressurized air from the vehicle air tank which itself is also used to operate other equipment such as air brakes and the power take-off equipment itself.

20 Claims, 3 Drawing Sheets

APPARATUS FOR AUTOMATICALLY CONTROLLING OPERATION OF THE THROTTLE ASSEMBLY OF A MOTOR VEHICLE ENGINE SYSTEM DURING OPERATION OF POWER TAKE-OFF EQUIPMENT

BACKGROUND OF THE INVENTION

1. Field of the Invention

The present invention deals with the field of devices usable for facilitating control of operation of the engine of a motor vehicle as well as auxiliary equipment powered therefrom commonly referred to as power take-off equipment. During operation of such power take-off equipment it is common for an operator of the vehicle to consider himself obligated to increase the speed of rotation of the motor vehicle engine in order to supply additional power to the power take-off equipment during operation thereof after movement of the power take-off switch to the "on" position. This is a natural inclination of a vehicle driver and often results in excessive fuel wasting and undue wear and tear on the engine and other rotating parts. The present invention provides a means for blocking control of motor speed rotation from the conventional accelerator pedal of the throttle linkage and for providing an additional throttle control system accessible internally or externally on the motor vehicle for increasing the speed of operation of the motor vehicle engine to the most efficient level for supplying significant additional power to the power take-off equipment while at the same time minimizing engine speed to prevent unnecessary fuel consumption.

2. Description of the Prior Art

Numerous prior art controlling devices for use with auxiliary equipment or for use with the throttle and fuel control system of the motor vehicle such as shown in U.S. Pat. No. 2,224,600 issued Dec. 10, 1940 to G. E. Howard on a "Speed Regulator"; and U.S. Pat. No. 2,852,086 issued Sep. 16, 1958 to D. F. Cordry on "Automatic Speed Control For Automotive Vehicles"; and U.S. Pat. No. 2,916,100 issued Dec. 8, 1959 to R. R. Teetor and assigned to Perfect Circle Corporation on a "Vehicle Speed Maintaining And Maximum Speed Controlling Device"; and U.S. Pat. No. Re. 25,012 issued Jul. 25, 1961 to T. M. Dressler and assigned to International Harvester Company on a "Governing Mechanism For Fuel Injection Pumps Of Diesel Engines"; and U.S. Pat. No. 3,102,522 issued Sep. 3, 1963 to F. Nallinger and assigned to Daimler-Benz Aktiengesellschaft on a "Control Arrangement For Internal Combustion Engines"; and U.S. Pat. No. 3,913,697 issued Oct. 21, 1975 to C. Greene on a "Vehicle Having A Power Take-Off And A Hydraulic Motor, And Method Of Driving Same"; and U.S. Pat. No. 3,916,854 issued Nov. 4, 1975 to R. Barton et al on a "Fuel-Flow Limiting Apparatus"; and U.S. Pat. No. 3,954,152 issued May 4, 1976 to R. Duttarer et al and assigned to Clark Equipment Company on a "Vehicle Speed Control"; and U.S. Pat. No. 4,445,476 issued May 1, 1984 to F. Eheim and assigned to Robert Bosch GmbH on a "RPM Governor Of A Fuel Injection Pump"; and U.S. Pat. No. 4,450,804 issued May 29, 1984 to W. Sauerschell et al and assigned to VDO Adolf Schindling AG on an "Apparatus For Increasing Idling Speed"; and U.S. Pat. No. 5,056,615 issued Oct. 15, 1991 to A. Duthie et al and assigned to Johnston Engineering Limited on a "Vehicle Control System"; and U.S. Pat. No. 5,152,360 issued Oct. 6, 1992 to D. Haefner et al and assigned to Eaton Corporation on a "Throttle Cable Intervention Device"; and U.S. Pat. No. 5,235,948 issued Aug. 17, 1993 to B. Grant et al and assigned to BG 300, Inc. on an "Adjustable Throttle Stop"; and U.S. Pat. No. 5,311,961 issued May 17, 1994 to E. Stabenow on a "Power-Take-Off Safety System".

SUMMARY OF THE INVENTION

The present invention provides an apparatus which is specifically designed for automatically controlling the operation of the throttle control system of a conventional motor vehicle engine. Normally the throttle system includes an accelerator pedal and a fuel pump which are both connected through throttle linkage with respect to the carburetor or fuel injection system of a motor vehicle for controlling the speed of engine rotation during idling and for controlling powering of the vehicle during acceleration and at other times during driving thereof.

The apparatus includes a blocker valve which preferably is a pneumatically controlled solenoid which is operable to move to an opened position whenever operation of the power take-off switch is in the "on" position. This blocker solenoid valve facilitates blocking of the operation of the accelerator pedal of the motor vehicle. However, when pneumatic pressure is removed from the blocker valve it is adapted to move to the steady state closed position where it remains during normal vehicle operation without operation of the power take-off equipment.

The apparatus further includes a throttle valve which preferably comprises a pneumatically controlled throttle solenoid which is designed to become open responsive to movement of the power take-off switch to the "on" position simultaneously with operation of a throttle switch to allow for controlled operation of the throttle linkage of the motor vehicle preferably by directly controlling the fuel pump of the engine system.

The throttle solenoid valve is designed to move to the closed position during normal vehicle operation whenever the power take-off switch is not operated or when one of the throttle switches is not initiated.

In the preferred configuration the throttle solenoid valve and the blocker solenoid valve are positioned adjacent to one another in mutual abutment in order to facilitate operation as well as powering of each solenoid.

A primary pneumatic line is positioned in fluid flow communication with a supply of pressurized air and is also in fluid flow communication with the blocker solenoid valve and with the throttle solenoid valve to supply pressurized air thereto selectively. A blocker pneumatic line extends from the blocker solenoid valve and is in fluid flow conmunication therewith to receive pressurized air from the blocker solenoid responsive to the blocker solenoid being in the opened position. In a similar manner a throttle pneumatic line extends from the throttle solenoid valve and is in fluid flow communication therewith to receive pressurized air therefrom responsive to the throttle solenoid valve being in the opened position.

A blocker cylinder is included which is preferably a pneumatically powered cylinder and is positioned in fluid flow communication with the blocker pneumatic line to receive pressurized air therefrom. The blocker cylinder includes a blocker piston movably mounted therewithin which is movable to a blocking position extending preferably outwardly from the blocker cylinder in such a manner as to abut and restrict operation of the motor vehicle accelerator pedal responsive to operation of the power take-off equipment. This position is achieved whenever the blocker solenoid valve is in the opened position and pressurized air is supplied to the blocker cylinder through the blocker pneumatic line.

A throttle cylinder is also included which is pneumatically powered and is in fluid flow communication with the throttle pneumatic line to receive pressurized air therefrom. This throttle cylinder includes a throttle piston movably mounted therein which is selectively movable to an operating position to facilitate operation of the fuel pump to urge operation of the vehicle motor at a desired operating speed thereof when actuated.

The apparatus of the present invention further includes a fuel pump operating means which is attached to the linkage adjacent the fuel pump of the vehicle and to the throttle piston to facilitate control of operation of the fuel pump thereby. In this manner the motor operating speed of the motor vehicle can be raised to a level between 1200–1500 revolutions per minute responsive to operation of the power take-off equipment as well as one of the throttle switches. The fuel pump operating device further includes a cable operatively attached to the fuel pump and to the throttle piston to urge operation of the motor vehicle at this elevated speed of 1200–1500 revolutions per minute. The fuel pump operating means further includes a throttle cylinder mounting bracket fixedly secured to the fuel pump preferably to position the throttle cylinder and the fuel pump operating system adjacent thereto.

A throttle control switch is preferably included positioned electrically between the power take-off switch and the throttle valve means to selectively control actuation of the fuel pump operating apparatus. This throttle control switch preferably includes a first throttle control switch member which is preferably positioned electrically in series with the power take-off switch and is located within the motor vehicle and preferably within the operator's cab of the motor vehicle. The throttle control switch preferably further includes a second throttle control switch member also positioned electrically in series with the power take-off switch in such a manner as to be electrically interconnected in parallel with respect to the first throttle control switch member to allow operation of the fuel pump operating apparatus responsive to closing of either of the switch members simultaneously with the power take-off switch. This second throttle control switch member is preferably located outside of the operator's cab of the motor vehicle.

The designed apparatus further preferably includes a protection valve positioned within the primarily pneumatic line which is designed to normally be in the opened position. This protection valve is responsive to air being supplied thereto at a pressure of below approximately 90 lbs. per square inch to thereby close in such a manner as to prevent fluid flow through the primary pneumatic line until the pressure reaches a level above 90 lbs. per square inch.

A blocker adjustment nut may also be included in the present invention threadedly engaged movably with the blocker piston to facilitate adjustment in relative positioning thereof with respect to the accelerator pedal of the motor vehicle. A blocker locking nut may also preferably be threadedly engaged movably with respect to the blocker piston in order to facilitate locking of the blocker adjustment nut in a detachably fixed position with respect to the blocker piston. A throttle adjustment nut may also be threadedly engaged movably with respect to the throttle piston in order to facilitate adjustment in relative positioning thereof with respect to the fuel pump of the motor vehicle.

It is an object of the present invention to provide an apparatus for automatically controlling operation of the throttle assembly of a motor vehicle engine system, during operation of power take-off equipment, wherein usage with many different types of power take-off equipment is possible.

It is an object of the present invention to provide an apparatus for automatically controlling operation of the throttle assembly of a motor vehicle engine system, during operation of power take-off equipment, wherein use specifically with a power take-off winch is significantly facilitated.

It is an object of the present invention to provide an apparatus for automatically controlling operation of the throttle assembly of a motor vehicle engine system, during operation of power take-off equipment, wherein additional capital cost outlay is minimized.

It is an object of the present invention to provide an apparatus for automatically controlling operation of the throttle assembly of a motor vehicle engine system, during operation of power take-off equipment, wherein maintenance requirements are minimized.

It is an object of the present invention to provide an apparatus for automatically controlling operation of the throttle assembly of a motor vehicle engine system, during operation of power take-off equipment, wherein reliability is increased and, thus, down time is significantly reduced.

It is an object of the present invention to provide an apparatus for automatically controlling operation of the throttle assembly of a motor vehicle engine system, during operation of power take-off equipment, wherein costs of maintenance are minimized.

It is an object of the present invention to provide an apparatus for automatically controlling operation of the throttle assembly of a motor vehicle engine system, during operation of power take-off equipment, wherein operation of the accelerator pedal of a motor vehicle is blocked at all times during operation of power take-off equipment.

It is an object of the present invention to provide an apparatus for automatically controlling operation of the throttle assembly of a motor vehicle engine system, during operation of power take-off equipment, wherein the operating speed of the engine of a motor vehicle can be increased during the operation of power take-off equipment if necessary by the actuation of a throttle switch.

It is an object of the present invention to provide an apparatus for automatically controlling operation of the throttle assembly of a motor vehicle engine system, during operation of power take-off equipment, wherein the operating speed of a motor vehicle can be increased during operation of power take-off equipment to an elevated efficient level but not excessively increased by closing of a throttle switch located internally within the operating cab of the motor vehicle.

It is an object of the present invention to provide an apparatus for automatically controlling operation of the throttle assembly of a motor vehicle engine system, during operation of power take-off equipment, wherein the operating speed of a motor vehicle engine can be increased to efficient level without incurring excessive fuel consumption by the actuation of a throttle switch located externally on the motor vehicle.

It is an object of the present invention to provide an apparatus for automatically controlling operation of the throttle assembly of a motor vehicle engine system, during operation of power take-off equipment, wherein assembly of the apparatus for automatically controlling operation of the throttle assembly can be easily and quickly performed.

It is an object of the present invention to provide an apparatus for automatically controlling operation of the throttle assembly of a motor vehicle engine system, during operation of power take-off equipment, wherein operation of the pneumatically controlled brakes of a motor vehicle can be maintained at all times when using the apparatus of the present invention by the inclusion of a protection valve which is in the pneumatic supply line immediately adjacent the air tank which is maintains the air pressure within the air tank at at least 90 lbs. per square inch.

It is an object of the present invention to provide an apparatus for automatically controlling operation of the throttle assembly of a motor vehicle engine system, during operation of power take-off equipment, wherein increased throttle engine operating speed during operation of power take-off equipment can be achieved by the closing of a throttle switch positioned either within the operator's cab or external thereto.

It is an object of the present invention to provide an apparatus for automatically controlling operation of the throttle assembly of a motor vehicle engine system, during operation of power take-off equipment, wherein adjustment and positioning of the blocker element is possible with respect to the accelerator pedal.

It is an object of the present invention to provide an apparatus for automatically controlling operation of the throttle assembly of a motor vehicle engine system, during operation of power take-off equipment, wherein adjustment and positioning of the throttle control linkage in relation to the fuel pump is made possible.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
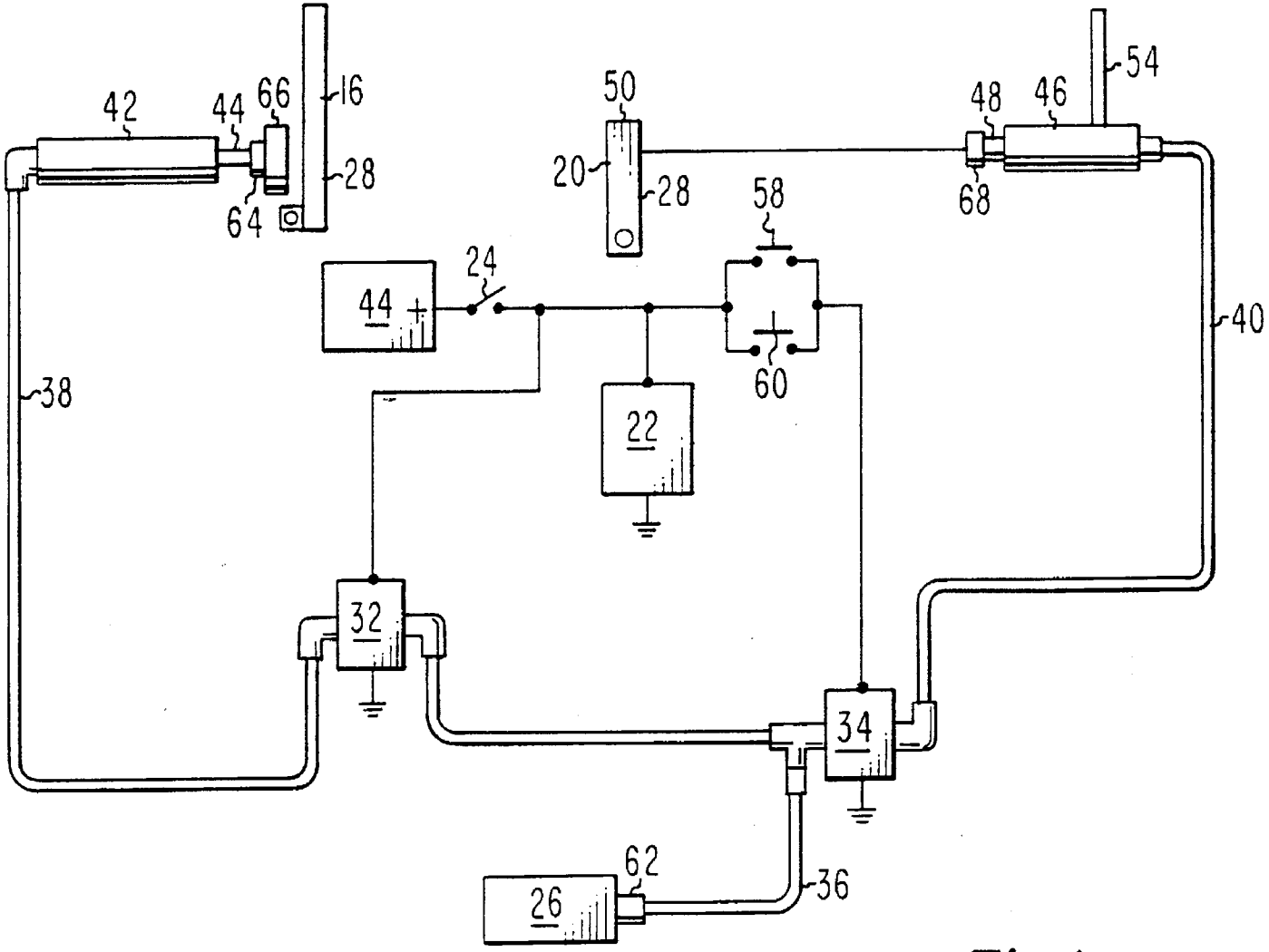
FIG. 1 is a schematic illustration of an embodiment of the apparatus for automatically controlling operation of the throttle assembly of a motor vehicle engine system of the present invention.
Figure 2:
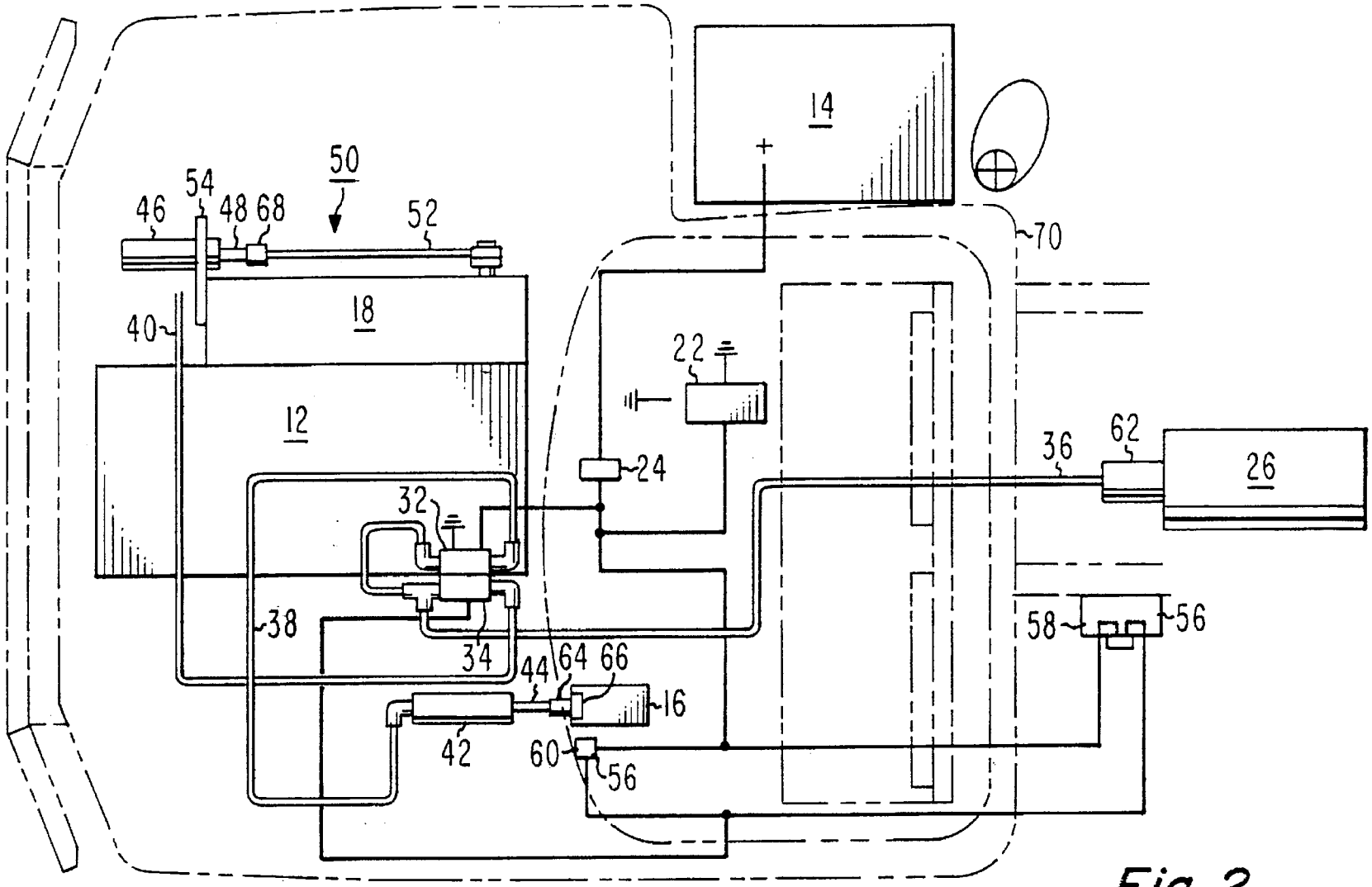
FIG. 2 is a top plan schematic illustration of the embodiment shown in FIG. 1.
Figure 3:
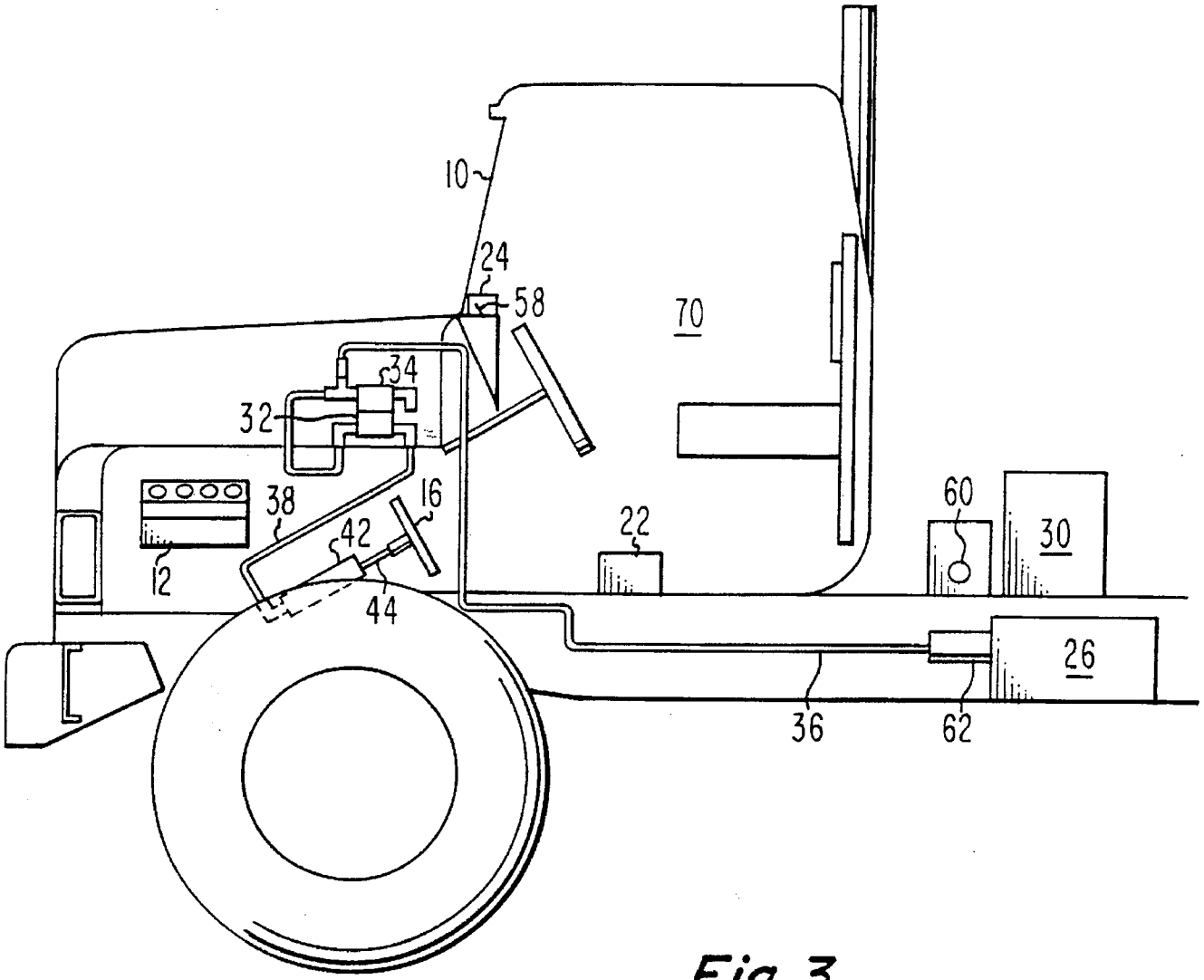
FIG. 3 is a side plan view of the schematic illustration shown in FIG. 2.

The present invention provides a unique apparatus for automatically controlling the operation of the throttle assembly 28 of a vehicle 10 and, in particular, in motor vehicle 12. Such vehicles normally have a throttle system which includes an accelerator pedal 16 which is operationally connected through throttle linkage to a fuel pump 18 which normally includes a fuel pump lever 20. This throttle assembly is designed for controlling the speed of operation of the vehicle motor 12 at all times during idling as well as during actual operation of the vehicle 10.

Such a vehicle normally also includes a vehicle battery 14. Also those vehicles which include auxiliary equipment such as a winch configuration or other similar equipment normally include an operating switch to initiate operation of this equipment. This equipment is also referred to as power take-off equipment 30 and can comprise a winch, lifting-boom or any similar equipment utilizing the vehicle motor 12 for power. The power of the vehicle motor 12 is often used to compress air within an air tank 26. This air is then made available for various reasons including operation of the power take-off equipment 30 as well as operation of conventional vehicle brakes also as well as for many other uses. The operation of power take-off equipment is often initiated by the closing of a power take-off switch 24 which operates a power take-off solenoid 22 which either initiates or causes the ceasing of operation of the power take-off equipment 30 such as a winch or other similar equipment. Such a power take-off switch 24 is often located within the operator's cab of a motor vehicle to facilitate access thereto at all times.

The apparatus of the present invention is designed to cooperate in operation with the power take-off equipment 30 as well as the power take-off switch 24 and the vehicle battery 14 as well as the air tank 26 in controlling operating speed of the motor vehicle engine to maximize driving of the power take-off equipment 30 while minimizing fuel consumption.

The construction of the apparatus of the present invention includes a blocker valve 32 which preferably comprises a blocker solenoid member for ultimately blocking operation of the accelerator pedal 16 when desired. This blocker solenoid valve 32 preferably receives pressurized air through a primary pneumatic line 36 which is positioned in fluid flow communication therewith as well as in fluid flow communication to the air tank 26. The downstream side of the blocker solenoid valve 32 is connected through a blocker pneumatic line 38 to a blocker pneumatic cylinder 42 which is positioned adjacent to the accelerator pedal 16. This pneumatic blocker cylinder 42 includes a blocker piston 44 movably mounted therein wherein the piston is movable responsive to nigh pressure being supplied to the pneumatic blocker cylinder 42 to move into abutting relation with respect to the accelerator pedal 16 to block downward movement thereof and thereby render the accelerator pedal 16 non-functional. Blocker piston 44 preferably includes a blocker adjustment nut 64 thereon for adjusting the relative position between the blocker piston 44 and the accelerator pedal 16. A blocker locking nut 66 is also preferably included for locking of the blocker adjustment nut 64 in a given position. Preferably both the blocker adjustment nut 64 and the blocker locking nut 66 are threadably engaged with respect to the blocker piston 44 in order to be movable therealong to facilitate adjustment of the relative positioning thereof with respect to the accelerator pedal 16.

The apparatus of the present invention further includes a throttle valve 34 which preferably comprises a throttle solenoid member which is in fluid flow communication with the primary pneumatic line 36 to receive pressurized air supplied therethrough. Downstream of the throttle solenoid valve 34 is positioned a throttle pneumatic line 40 which is in fluid flow communication with the downstream side of the throttle solenoid valve 34 to receive pressurized air therethrough when the throttle solenoid valve 34 is in the opened position. Throttle pneumatic line 40 is adapted to receive pressurized air for communication through the throttle pneumatic line 40 which extends to and is in fluid flow communication with the throttle pneumatic cylinder 46. The throttle pneumatic cylinder 46 includes a pneumatic throttle piston 48 positioned therein which is movable with respect thereto and is attached with respect to the throttle linkage preferably adjacent the fuel pump 18 of the motor vehicle 10 to control operation thereof and preferably to increase operating speed thereof to a level of 1200–1500 rpms. This engine operating speed of revolution has been determined to be the most efficient operating speed for simultaneously minimizing fuel consumption while at the same time providing a sufficient amount of power for driving of the power take-off equipment 30 during operation thereof.

The throttle cylinder 46 is operatively connected with respect to the fuel pump operating means 50. The fuel pump operating means preferably includes a cable 52 which extends from the throttle piston 48 to the fuel pump lever 20 which is mounted pivotally and is interconnected operatively with respect to the fuel pump 18 for controlling operation thereof.

In this configuration preferably the pneumatic throttle cylinder 46 is designed to be mounted adjacent the fuel pump 18 and for this purpose a throttle cylinder mounting bracket 54 is preferably fixedly secured to the fuel pump 18 as well as to the pneumatic throttle cylinder 46 for retaining thereof in fixed position with respect to the fuel pump 18. The throttle pneumatic piston 48 preferably includes a throttle adjustment nut 68 thereon which is threadedly engaged with respect to the piston such that rotation of the throttle adjustment nut 68 will adjust the relative positioning of the throttle piston 48 with respect to the fuel pump lever 20. In this manner adjustment of positioning and operation of the fuel pump lever is achieved by effectively controlling the effective length of the cable 52 which is controlled by the relative positioning between the throttle piston 48 and the fuel pump lever 20.

In the apparatus of the present invention it is preferable that the movement of the power take-off switch 24 to the closed position to initiate operation of the power take-off equipment 30 simultaneously initiate blocking of operation of the accelerator pedal 16. For this reason closing of switch 24 will immediately cause opening of the blocker solenoid valve 32 which will cause movement of the blocker piston 44 to the blocking position relative to the accelerator pedal 16. However, it is not desired that the closing of the power take-off switch 24 initiate immediate operation of the throttle control means and movement of the throttle piston 48. For this reason a throttle control switch 56 is included in electrical circuitry of the present design between the power take-off switch 24 and the throttle solenoid member 34. This throttle control switch 56 preferably includes a first throttle control switch member 58 positioned within the operator's cab 70 to facilitate access thereto. The throttle control switch preferably also includes a second throttle control switch member 60 electrically in parallel with respect to the first throttle control switch member 58. The second throttle control switch member 60, however, is preferably positioned outside of the operator's cab to facilitate actuation thereof when the operator is outside of the operator's cab 70, for example, attending to operation of the power take-off equipment.

Since the configuration of the present invention is designed to be used with the conventional air tank 26 of a motor vehicle 10 it is preferable to include a protection valve 62 in the primary air line 36 leading to the apparatus of the present invention. This protection valve is necessary in order to maintain an air pressure within the air tank 26 of at least 90 lbs. which is the minimum required normally in order to operate the pneumatic brakes of a commercial vehicle 10. Thus the protection valve 62 which is normally in the opened position is responsive to move to the closed position whenever the pressurized air supplied thereto is below a given level which is preferably 90 lbs. per square inch.

In operation the apparatus of the present invention is designed to be operable whenever the power take-off switch 24 is moved to the closed position. Power take-off switch 24 is moved to the closed position whenever initiation of operation of the power take-off equipment 30 such as a winch or the like is desired. The closing of the power take-off switch 24 initiates operation of the power take-off solenoid 22 which initiates operation of the power take-off equipment 30. When operation of the equipment is started by closing of switch 24 the apparatus of the present invention is designed to immediately move the solenoid blocker valve 32 to the open position to allow pressurized air supplied from the air tank 26 through the primary pneumatic line 36 to pass through the blocker solenoid valve 32 into the blocker pneumatic line 38. The air is then supplied through line 38 to the pneumatic blocker cylinder 42 thereby moving blocker piston 44 into the blocking position relative to the accelerator pedal 16 thereby preventing accelerator pedal 16 from any movement to control the throttle system of the motor vehicle 10. As such the operating speed of the vehicle motor 12 will remain at idle. Thus, the natural tendency of the vehicle operator to increase engine operating speed by depressing the accelerator pedal 16 in order to supply additional power to the power take-off equipment 30 will be prevented.

It is preferable, however, to increase the engine operating speed to a limited extent to supply additional power to the power take-off equipment 30 but not to such an extent that wasted power is supplied and thereby fuel consumption is unnecessarily increased. To increase the engine operating speed to the desired level the internal throttle switch 58 or the external throttle switch 60 may be moved to the closed position in order to supply electrical power to the throttle solenoid member 34 causing it to open. When in the opened position the throttle solenoid valve 34 will receive pressurized air from the air tank 26 through the primarily pneumatic line 36, through the throttle solenoid valve 34 and into the throttle pneumatic line 40. This pressurized air will then pass into the pneumatic throttle cylinder 46 causing movement of the throttle piston 48 to a position whereby the cable 52 will cause movement of the fuel pump lever 20 to a position relative to the fuel pump 18 to cause an increase in the vehicle operating speed from idle up to a level of preferably between 1200–1500 rpm. This increase in engine operating speed will not occur until either the internal throttle switch 58 or the external throttle switch 60 is moved to the closed position. This increased operating speed of 1200–1500 rpm has been found to supply enough additional power for full and efficient operation of the power take-off equipment 30 while at the same time not providing excessive power thereto and, thus, eliminating the wasting of additional fuel.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. An apparatus for automatically controlling operation of the throttle assembly of a motor vehicle engine system, which includes an accelerator pedal and a fuel pump, during operation of power-take-off equipment including a power-take-off switch, which comprises:

A. a blocker valve means being pneumatically controlled and being operable to move to an opened position responsive to operation of a power-take-off means to facilitate blocking of operation of an accelerator pedal of a motor vehicle and being operable to move to a closed position during normal vehicle operation without operation of the power-take-off means;

B. a throttle valve means being pneumatically controlled and being operable to move to an opened position to allow controlled operation of the fuel pump of a motor vehicle engine system to control motor operating speed, said throttle valve means being operable to move to a closed position during normal vehicle operation without power-take-off;

C. a primary pneumatic line means being in fluid flow communication with a supply of pressurized air and further being in fluid flow communication with said blocker valve means and with said throttle valve means to supply pressurized air thereto;

D. a blocker pneumatic line means extending from said blocker valve means and being in fluid flow communication therewith to receive pressurized air therefrom responsive to said blocker valve means being in the opened position;

E. a throttle pneumatic line means extending from said throttle valve means and being in fluid flow communication therewith to receive pressurized air therefrom responsive to said throttle valve means being in the opened position;

F. a blocker cylinder means in fluid flow communication with said blocker pneumatic line means to receive pressurized air therefrom, said blocker cylinder means including a blocker piston means movably mounted therein, said blocker piston means being movable to a blocking position to restrict operation of the motor vehicle accelerator pedal responsive to operation of the power-take-off equipment with said blocker valve means being in the opened position and with pressurized air being supplied to said blocker cylinder means through said blocker pneumatic line means;

G. a throttle cylinder means in fluid flow communication with said throttle pneumatic line means to receive pressurized air therefrom, said throttle cylinder means including a throttle piston means movably mounted therein, said throttle piston means being selectively movable to a operating position to facilitate operation of the fuel pump to urge operation the vehicle motor at a desired operating speed thereof to facilitate operation of power-take-off equipment responsive to said throttle valve means being in the opened position with pressurized air being supplied to said throttle cylinder means through said throttle pneumatic line means; and H. a fuel pump operating means attached to the fuel pump of the vehicle and to said throttle piston means to facilitate control of operation of the fuel pump by the throttle piston means to selectively control motor operating speed.

2. An apparatus for automatically controlling operation of the throttle assembly of a motor vehicle engine system, which includes an accelerator pedal and a fuel pump, during operation of power-take-off equipment, as defined in claim 1 further comprising a throttle control switch means positioned electrically between the power-take off actuation switch and said throttle valve means to selectively control actuation of said fuel pump operating means.

3. An apparatus for automatically controlling operation of the throttle assembly of a motor vehicle engine system, which includes an accelerator pedal and a fuel pump, during operation of power-take-off equipment, as defined in claim 2 wherein said throttle control switch means includes a first throttle control switch member and a second throttle control switch member being interconnected electrically in parallel to allow operation of said fuel pump operating means responsive to closing of either of said first and second throttle control switch members.

4. An apparatus for automatically controlling operation of the throttle assembly of a motor vehicle engine system, which includes an accelerator pedal and a fuel pump, during operation of power-take-off equipment, as defined in claim 3 wherein said first throttle control switch member is positioned within the motor vehicle and wherein said second throttle control switch member is positioned outside of the motor vehicle.

5. An apparatus for automatically controlling operation of the throttle assembly of a motor vehicle engine system, which includes an accelerator pedal and a fuel pump, during operation of power-take-off equipment, as defined in claim 2 wherein 2 wherein said throttle control switch means is positioned electrically in series with respect to the power-take-off switch.

6. An apparatus for automatically controlling operation of the throttle assembly of a motor vehicle engine system, which includes an accelerator pedal and a fuel pump, during operation of power-take-off equipment, as defined in claim 1 further including a protection valve means positioned within said primary pneumatic line means and being normally open, said protection valve means being responsive to air being supplied thereto below a given pressure to close to prevent fluid flow through said primary pneumatic line means.

7. An apparatus for automatically controlling operation of the throttle assembly of a motor vehicle engine system, which includes an accelerator pedal and a fuel pump, during operation of power-take-off equipment, as defined in claim 6 wherein said protection valve means is responsive to air being supplied thereto below ninety pounds per square inches of pressure to close.

8. An apparatus for automatically controlling operation of the throttle assembly of a motor vehicle engine system, which includes an accelerator pedal and a fuel pump, during operation of power-take-off equipment, as defined in claim 1 wherein said fuel pump operating means includes a cable means operatively attached to the fuel pump and to said throttle piston means to urge operation of the vehicle motor at a predetermined operating speed.

9. An apparatus for automatically controlling operation of the throttle assembly of a motor vehicle engine system, which includes an accelerator pedal and a fuel pump, during operation of power-take-off equipment, as defined in claim 1 wherein said fuel pump operating means further includes a throttle cylinder mounting bracket fixedly secured to the fuel pump to position said throttle cylinder means and said fuel pump operating means thereadjacent.

10. An apparatus for automatically controlling operation of the throttle assembly of a motor vehicle engine system, which includes an accelerator pedal and a fuel pump, during operation of power-take-off equipment, as defined in claim 1 wherein said blocker valve means includes a blocker solenoid member being electrically connected to the power-take-off switch to be activated therewith.

11. An apparatus for automatically controlling operation of the throttle assembly of a motor vehicle engine system, which includes an accelerator pedal and a fuel pump, during operation of power-take-off equipment, as defined in claim 2 wherein said throttle valve means includes a throttle solenoid member being electrically connected to said throttle control switch means and the power-take-off switch to be responsive to close responsive to said throttle control switch means and the power-take-off switch being simultaneously closed.

12. An apparatus for automatically controlling operation of the throttle assembly of a motor vehicle engine system, which includes an accelerator pedal and a fuel pump, during operation of power-take-off equipment, as defined in claim 1 further including a blocker adjustment nut means threadably engaged movably to said blocker piston means to facilitate adjustment in relative positioning thereof with respect to the accelerator pedal of the motor vehicle.

13. An apparatus for automatically controlling operation of the throttle assembly of a motor vehicle engine system, which includes an accelerator pedal and a fuel pump, during operation of power-take-off equipment, as defined in claim 12 further comprising a blocker locking nut means being threadably engaged movably to said blocker piston means to facilitate locking of said blocker adjustment nut means in a detachably fixed position with respect to said blocker piston means.

14. An apparatus for automatically controlling operation of the throttle assembly of a motor vehicle engine system, which includes an accelerator pedal and a fuel pump, during operation of power-take-off equipment, as defined in claim 1 further including a throttle adjustment nut means threadably engaged movably to said throttle piston means to facilitate adjustment in relative positioning thereof with respect to the fuel pump of the motor vehicle.

15. An apparatus for automatically controlling operation of the throttle assembly of a motor vehicle engine system, which includes an accelerator pedal and a fuel pump, during operation of power-take-off equipment, as defined in claim 1 wherein said blocker cylinder means is pneumatically powered.

16. An apparatus for automatically controlling operation of the throttle assembly of a motor vehicle engine system, which includes an accelerator pedal and a fuel pump, during operation of power-take-off equipment, as defined in claim 1 wherein said throttle cylinder means is pneumatically powered.

17. An apparatus for automatically controlling operation of the throttle assembly of a motor vehicle engine system, which includes an accelerator pedal and a fuel pump, during operation of power-take-off equipment, as defined in claim 1 wherein said throttle cylinder means and said fuel pump operation means are responsive upon actuation thereof to urge operation of the vehicle motor at between approximately 1200 and 1500 revolutions per minute.

18. An apparatus for automatically controlling operation of the throttle assembly of a motor vehicle engine system, which includes an accelerator pedal and a fuel pump, during operation of power-take-off equipment, as defined in claim 1 wherein said blocker valve means and said throttle valve means are positioned in direct abutment with respect to one another to facilitate operation and powering thereof.

19. An apparatus for automatically controlling operation of the throttle assembly of a motor vehicle engine system, which includes an accelerator pedal and a fuel pump, during operation of power-take-off equipment including a power-take-off switch, which comprises:

A. a blocker valve means being pneumatically controlled and being operable to move to an opened position responsive to operation of a power-take-off means to facilitate blocking of operation of an accelerator pedal of a motor vehicle and being operable to move to a closed position during normal vehicle operation without operation of the power-take-off means;

B. a throttle valve means being pneumatically controlled and being operable to move to an opened position to facilitate control of motor operating speed, said throttle valve means being operable to move to a closed position during normal vehicle operation without operation of the power-take-off equipment;

C. a primary pneumatic line means being in fluid flow communication with a supply of pressurized air and further being in fluid flow communication with said blocker valve means and with said throttle valve means to supply pressurized air thereto;

D. a blocker pneumatic line means extending from said blocker valve means and being in fluid flow communication therewith to receive pressurized air therefrom responsive to said blocker valve means being in the opened position;

E. a throttle pneumatic line means extending from said throttle valve means and being in fluid flow communication therewith to receive pressurized air therefrom responsive to said throttle valve means being in the opened position;

F. a blocker cylinder means being pneumatically powered and in fluid flow communication with said blocker pneumatic line means to receive pressurized air therefrom, said blocker cylinder means including a blocker piston means movably mounted therein, said blocker piston means being movable to a blocking position to restrict operation of the motor vehicle accelerator pedal responsive to operation of the power-take-off equipment with said blocker valve means being in the opened position and with pressurized air being supplied to said blocker cylinder means through said blocker pneumatic line means;

G. a throttle cylinder means being pneumatically powered and in fluid flow communication with said throttle pneumatic line means to receive pressurized air therefrom, said throttle cylinder means including a throttle piston means movably mounted therein, said throttle piston means being selectively movable to a operating position to facilitate operation of the fuel pump to urge operation the vehicle motor at a desired operating speed thereof responsive to said throttle valve means being in the opened position with pressurized air being supplied to said throttle cylinder means through said throttle pneumatic line means;

H. a fuel pump operating means attached to the fuel pump of the vehicle and to said throttle piston means to facilitate control of operation of the fuel pump by the throttle piston means to selectively control motor operating speed between approximately 1200 and 1500 revolutions per minute;

I. a throttle control switch means positioned electrically between the power-take off actuation switch and said throttle valve means to selectively control actuation of said fuel pump operating means, said throttle control switch means further including:

(1) a first throttle control switch member positioned electrically in series with the power-take-off switch and being located within the motor vehicle; and (2) a second throttle control switch member also positioned electrically in series with the power-take-off switch and being interconnected electrically in parallel with respect to said first throttle control switch member to allow operation of said fuel pump operating means responsive to closing of either of said switch members simultaneously with the power-take-off switch, said second throttle control switch member being located outside of the motor vehicle.

20. An apparatus for automatically controlling operation of the throttle assembly of a motor vehicle engine system, which includes an accelerator pedal and a fuel pump, during operation of power-take-off equipment including a power-take-off switch, which comprises:

A. a blocker valve means being pneumatically controlled and being operable to move to an opened position responsive to operation of a power-take-off means to facilitate blocking of operation of an accelerator pedal of a motor vehicle and being operable to move to a closed position during normal vehicle operation without operation of the power-take-off means, said blocker valve means including a blocker solenoid member being electrically connected to the power-take-off switch to be activated therewith;

B. a throttle valve means being pneumatically controlled and being operable to move to an opened position to facilitate controlled operation of the fuel pump of a motor vehicle engine system to control motor operating speed to facilitate powering of power-take-off equipment, said throttle valve means being operable to move to a closed position during normal vehicle operation, said throttle valve means including a throttle solenoid member, said blocker valve means and said throttle valve means being positioned in direct abutment with respect to one another to facilitate operation and powering thereof;

C. a primary pneumatic line means being in fluid flow communication with a supply of pressurized air and further being in fluid flow communication with said blocker valve means and with said throttle valve means to supply pressurized air thereto;

D. a blocker pneumatic line means extending from said blocker valve means and being in fluid flow communication therewith to receive pressurized air therefrom responsive to said blocker valve means being in the opened position;

E. a throttle pneumatic line means extending from said throttle valve means and being in fluid flow communication therewith to receive pressurized air therefrom responsive to said throttle valve means being in the opened position;

F. a blocker cylinder means being pneumatically powered and in fluid flow communication with said blocker pneumatic line means to receive pressurized air therefrom, said blocker cylinder means including a blocker piston means movably mounted therein, said blocker piston means being movable to a blocking position to restrict operation of the motor vehicle accelerator pedal responsive to operation of the power-take-off equipment with said blocker valve means being in the opened position and with pressurized air being supplied to said blocker cylinder means through said blocker pneumatic line means;

G. a throttle cylinder means being pneumatically powered and in fluid flow communication with said throttle pneumatic line means to receive pressurized air therefrom, said throttle cylinder means including a throttle piston means movably mounted therein, said throttle piston means being selectively movable to a operating position to facilitate operation of the fuel pump to urge operation the vehicle motor at a desired operating speed thereof responsive to said throttle valve means being in the opened position with pressurized air being supplied to said throttle cylinder means through said throttle pneumatic line means;

H. a fuel pump operating means attached to the fuel pump of the vehicle and to said throttle piston means to facilitate control of operation of the fuel pump by the throttle piston means to selectively control motor operating speed between approximately 1200 and 1500 revolutions per minute, said fuel pump operating means including a cable means operatively attached to the fuel pump and to said throttle piston means to urge operation of the vehicle motor at a speed of approximately 1200–1500 revolutions per minute, said fuel pump operating means further including a throttle cylinder mounting bracket fixedly secured to the fuel pump to position said throttle cylinder means and said fuel pump operating means thereadjacent;

I. a throttle control switch means positioned electrically between the power-take off actuation switch and said throttle valve means to selectively control actuation of said fuel pump operating means, said throttle control switch means further including:

(1) a first throttle control switch member positioned electrically in series with the power-take-off switch and being located within the motor vehicle; and (2) a second throttle control switch member also positioned electrically in series with the power-take-off switch and being interconnected electrically in parallel with respect to said first throttle control switch member to allow operation of said fuel pump operating means responsive to closing of either of said first and second throttle control switch members simultaneously with the power-take-off switch, said second throttle control switch member being located outside of the motor vehicle;

J. a protection valve means positioned within said primary pneumatic line means and being normally open, said protection valve means being responsive to air being supplied thereto below a pressure of ninety pounds per square inch to close to prevent fluid flow through said primary pneumatic line means;

K. a blocker adjustment nut means threadably engaged movably to said blocker piston means to facilitate adjustment in relative positioning thereof with respect to the accelerator pedal of the motor vehicle;

L. a blocker locking nut means being threadably engaged movably to said blocker piston means to facilitate locking of said blocker adjustment nut means in a detachably fixed position with respect to said blocker piston means; and M. a throttle adjustment nut means threadably engaged movably to said throttle piston means to facilitate adjustment in relative positioning thereof with respect to the fuel pump of the motor vehicle.

* * * * *